US012577485B2

(12) United States Patent
Wagner et al.

(10) Patent No.: US 12,577,485 B2
(45) **Date of Patent: *Mar. 17, 2026**

(54) PROCESS FOR REDUCTION OF ASPHALTENES FROM MARINE FUELS

(71) Applicant: BASF SE, Ludwigshafen am Rhein (DE)

(72) Inventors: Jochen Wagner, Ludwigshafen (DE); Silvia Hoffmann, Ludwigshafen (DE); Ingo Gottschling, Ludwigshafen (DE); Markus Hansch, Ludwigshafen (DE); Timo Baumgaertner, Ludwigshafen (DE)

(73) Assignee: BASF SE, Ludwigshafen am Rhein (DE)

( * ) Notice: Subject to any disclaimer, the term of this patent is extended or adjusted under 35 U.S.C. 154(b) by 0 days.

This patent is subject to a terminal disclaimer.

(21) Appl. No.: 18/700,534

(22) PCT Filed: Oct. 11, 2022

(86) PCT No.: PCT/EP2022/078249

§ 371 (c)(1),
(2) Date: Apr. 11, 2024

(87) PCT Pub. No.: WO2023/062006

PCT Pub. Date: Apr. 20, 2023

(65) Prior Publication Data

US 2024/0417637 A1 Dec. 19, 2024

(30) Foreign Application Priority Data

Oct. 15, 2021 (EP) ..... 21202907

(51) Int. Cl.

| | |
|---|---|
| ***C10L 1/232*** | (2006.01) |
| ***C10L 1/14*** | (2006.01) |
| ***C10L 1/222*** | (2006.01) |
| ***C10L 1/224*** | (2006.01) |
| ***C10L 10/18*** | (2006.01) |

(52) U.S. Cl.

CPC ..... *C10L 1/232* (2013.01); *C10L 1/143* (2013.01); *C10L 1/2222* (2013.01); *C10L 1/224* (2013.01); *C10L 10/18* (2013.01); *C10L 2200/0438* (2013.01)

(58) Field of Classification Search

CPC ..... C10L 1/143; C10L 1/1641; C10L 1/2222; C10L 1/2225; C10L 1/224; C10L 1/232; C10L 1/2368; C10L 1/2437; C10L 10/18; C10L 2200/0438; C10L 2270/026

See application file for complete search history.

(56) References Cited

U.S. PATENT DOCUMENTS

| | | | | |
|---|---|---|---|---|
| 5,214,224 | A | 5/1993 | Comer et al. | |
| 10,689,326 | B2 | 6/2020 | Hansch et al. | |
| 10,815,444 | B2 | 10/2020 | Hansch et al. | |
| 11,912,950 | B2 | 2/2024 | Hansch et al. | |
| 2018/0230387 | A1* | 8/2018 | Moore | B01J 8/0278 |
| 2020/0199472 | A1 | 6/2020 | Kerby et al. | |
| 2021/0253965 | A1 | 8/2021 | Woodchick et al. | |
| 2021/0363445 | A1* | 11/2021 | Kar | C10L 1/02 |
| 2022/0220401 | A1* | 7/2022 | Harhausen | C10L 1/2225 |

FOREIGN PATENT DOCUMENTS

| | | | | |
|---|---|---|---|---|
| CN | 112831362 | A | 5/2021 | |
| GB | 2496514 | A | 5/2013 | |
| JP | 2020105293 | A * | 7/2020 | |
| WO | WO-2006/135881 | A2 | 12/2006 | |
| WO | WO-2008/060888 | A2 | 5/2008 | |
| WO | WO-2009013536 | A2 * | 1/2009 | C10L 10/02 |
| WO | WO-2010/132259 | A1 | 11/2010 | |
| WO | WO-2011/095819 | A1 | 8/2011 | |
| WO | WO-2012/004300 | A1 | 1/2012 | |
| WO | WO-2012/039900 | A2 | 3/2012 | |
| WO | WO-2013/000997 | A1 | 1/2013 | |
| WO | WO-2013/064689 | A1 | 5/2013 | |
| WO | WO-2013/087701 | A1 | 6/2013 | |
| WO | WO-2013/117616 | A1 | 8/2013 | |
| WO | WO-2014/064151 | A1 | 5/2014 | |
| WO | WO-2014/193692 | A1 | 12/2014 | |
| WO | WO-2014/195464 | A1 | 12/2014 | |
| WO | WO-2014/202425 | A2 | 12/2014 | |
| WO | WO-2015/040147 | A1 | 3/2015 | |
| WO | WO-2020224974 | A1 * | 11/2020 | C10L 1/143 |

OTHER PUBLICATIONS

European Search Report for EP Patent Application No. 21202907.8, Issued on Mar. 18, 2022, 3 pages.

International Search Report for PCT Patent Application No. PCT/EP2022/078249, Issued on Jan. 31, 2023, 4 pages.

Monique B. Vermeire, "Everything You Need to Know About Marine Fuels", Chevron Marine Products, Jun. 2012, pp. 1-32.

Written Opinion for PCT Patent Application No. PCT/EP2022/078249, Issued on Jan. 31, 2023, 5 pages.

International Preliminary Report on Patentability for PCT Patent Application No. PCT/EP2022/078249, Issued on Apr. 25, 2024, 7 pages.

Office Action received for U.S. Appl. No. 18/700,023, mailed on May 21, 2025, 16 pages.

U.S. Appl. No. 18/700,023, filed Apr. 10, 2024, Wagner et al.

* cited by examiner

*Primary Examiner* — Latosha Hines

(74) *Attorney, Agent, or Firm* — Grüneberg Global IP, PLLC

(57) ABSTRACT

A process dissolves or disperses asphaltenes from marine fuels by using at least one quaternary ammonium compound. A weight ratio of aromatics to asphaltenes in the marine fuel is not more than 7.0. A marine fuel is produced that includes saturates, aromatics, and asphaltenes in addition to at least one quaternary ammonium compound. Another process reduces or prevents fouling caused by asphaltenes in a marine fuel.

20 Claims, No Drawings

PROCESS FOR REDUCTION OF ASPHALTENES FROM MARINE FUELS

CROSS-REFERENCE TO RELATED APPLICATIONS

This application is a National Stage entry under § 371 of International Application No. PCT/EP2022/078249, filed on Oct. 11, 2022, and which claims the benefit of priority to European Patent Application No. 21202907.8, filed on Oct. 15, 2021. The content of each of these applications is hereby incorporated by reference in its entirety.

The present invention discloses a process for reduction of asphaltenes from marine fuels using quaternary ammonium compounds in certain marine fuels, the use of such quaternary ammonium compounds, and certain marine fuels comprising such quaternary ammonium compounds.

Asphaltenes are a widespread constituent of crude oils and refinery stream thereof. In fuels with a certain composition such asphaltenes tend to precipitate from the fuels causing fouling of equipment in contact with the fuel, unless they are dissolved or dispersed.

The nature, chemical, and physical properties of asphaltenes are described in U.S. Pat. No. 5,214,224, furthermore U.S. Pat. No. 5,214,224 discloses certain copolymers for the dispersion of asphaltenes. Regardless of their chemical composition and constitution asphaltenes in the context of the present invention are determined in accordance with ASTM D3279 and are defined as that part of a marine fuel which is determined according to this method.

WO 2014/193692 A1 discloses a method of asphaltene control in a hydrocarbon fluid using certain quaternary ammonium compounds. Inter alia as hydrocarbon fluids marine fuel oils are mentioned, the composition of such oils is not explicitly disclosed, it is mentioned that such oils include aliphatic or liquid aromatic oils.

It was an object of the present invention to provide a method for further reducing fouling caused by asphaltenes in marine fuels.

The object was achieved by the use of at least one quaternary ammonium compound for dissolving or dispersing asphaltenes in marine fuels comprising

- 5 to 70 wt % saturates (determined according to SARA analysis using TLC-FID, IP 469), preferably 5 to 60, more preferably 10 to 50 wt %
- 10 to 85 wt % aromatics (determined according to SARA analysis using TLC-FID, IP 469), preferably 20 to 80, more preferably 30 to 70 wt %, and
- 1 to 30 wt % asphaltenes (determined according to SARA analysis using TLC-FID, IP 469), preferably 3 to 25, more preferably 5 to 20 wt %, with the proviso that the sum of saturates, aromatics, and asphaltenes is less than 100 wt %, wherein the weight ratio of aromatics to asphaltenes is not more than 7.0, preferably not more than 6.0, more preferably not more than 5.5, very more preferably not more than 5.0, even more preferably not more than 4.5, and especially not more than 4.0.

Another object of the present invention is a marine fuel composition, comprising

- 5 to 70 wt % saturates (determined according to SARA analysis using TLC-FID, IP 469), preferably 5 to 60, more preferably 10 to 50 wt %,
- 10 to 85 wt % aromatics (determined according to SARA analysis using TLC-FID, IP 469), preferably 20 to 80, more preferably 30 to 70 wt %,

- 1 to 30 wt % asphaltenes (determined according to SARA analysis using TLC-FID, IP 469), preferably 3 to 25, more preferably 5 to 20 wt %, and
- 50 to 2000 ppm by weight of at least one quaternary ammonium compound, preferably 60 to 1500, and more preferably 70 to 1000 ppm by weight, wherein the weight ratio of aromatics to asphaltenes is not more than 7.0, preferably not more than 6.0, more preferably not more than 5.5, very more preferably not more than 5.0, even more preferably not more than 4.5, and especially not more than 4.0.

Another object of the present invention is a process for reducing or preventing fouling caused by asphaltenes in marine fuels comprising

- 5 to 70 wt % saturates (determined according to SARA analysis using TLC-FID, IP 469), preferably 5 to 60, more preferably 10 to 50 wt %,
- 10 to 85 wt % aromatics (determined according to SARA analysis using TLC-FID, IP 469), preferably 20 to 80, more preferably 30 to 70 wt %,
- 1 to 30 wt % asphaltenes (determined according to SARA analysis using TLC-FID, IP 469), preferably 3 to 25, more preferably 5 to 20 wt %, and wherein the weight ratio of aromatics to asphaltenes is not more than 7.0, preferably not more than 6.0, more preferably not more than 5.5, very more preferably not more than 5.0, even more preferably not more than 4.5, and especially not more than 4.0 by adding 50 to 2000 ppm by weight of at least one quaternary ammonium compound to the said marine fuel, preferably 60 to 1500, and more preferably 70 to 1000 ppm by weight.

In a preferred embodiment of this process according to the invention it is possible to reduce the potential total sediment (TSP) value, determined according to ISO 10307-2:2009(E), procedure A, of the unadditised marine fuel by at least 25%, preferably by at least 30%, more preferably by at least 35%, and even by at least 40% by adding the indicated amounts of at least one quaternary ammonium compound to the said marine fuel.

The basis underlying this invention is the observation that quaternary ammonium compounds are more effective in dissolving or dispersing asphaltenes in marine fuels with a lower content of aromatics than in those with a higher content.

Therefore, the use of quaternary ammonium compounds is preferred in marine fuels with a content of aromatics and polyaromatics according to IP 469 of not more than 50 wt %, more preferably not more than 45 wt %.

For the sake of simplicity within this text aromatics and polyaromatics according to IP 469 are collectively referred to as "aromatics" and polyaromatics are deemed to be included, even if not explicitly mentioned.

With regard to marine fuels saturates, aromatics, and asphaltenes refer to those compounds which are determined according to the respective SARA analysis.

It should be mentioned that the content of asphaltenes is independent of the content of saturates, aromatics, and resins in the marine fuel, so that the amounts of asphaltenes (determined according to SARA analysis using TLC-FID, IP 469) in the marine fuel is from 1 to 30 wt % asphaltenes, preferably from 3 to 25, and more preferably from 5 to 20 wt % irrespective of the content of saturates, aromatics, and/or resins.

The invention is described in further detail as follows:

Marine Fuel

The fuel is a marine fuel, such as MGO (Marine gas oil), MDO (Marine diesel oil), IFO (Intermediate fuel oil), MFO (Marine fuel oil), or HFO (Heavy fuel oil). Further examples for marine fuel are IFO 380 (an Intermediate fuel oil with a maximum viscosity of 380 centistokes at 50° C. (<3.5% sulphur)), IFO 180 (an Intermediate fuel oil with a maximum viscosity of 180 centistokes (<3.5% sulphur)), LS 380 (a Low-sulphur (<1.0%) intermediate fuel oil with a maximum viscosity of 380 centistokes), LS 180 (a Low-sulphur (<1.0%) intermediate fuel oil with a maximum viscosity of 180 centistokes), LSMGO (a Low-sulphur (<0.1%) Marine Gas Oil, which is often be used in European Ports and Anchorages according to EU Sulphur directive 2005/33/EC), or ULSMGO (a Ultra-Low-Sulphur Marine Gas Oil, also referred to as Ultra-Low-Sulfur Diesel (sulphur 0.0015% max). Further suitable marine fuels are according to DIN ISO 8217 of the category ISO-F-DMX, DMA, DFA, DMZ, DFZ, or DFB, or ISO-F RMA, RMB, RMD, RME, RMG, or RMK. Further suitable marine fuel is distillate marine diesel or residual marine diesel.

The viscosity of the fuel, such as the marine fuel, can vary in a broad range, such as in the range from 1 to 10,000 $mm^2/s$ at 40° C. (ISO 3104) or 1 to 1000 $mm^2/s$ at 50° C. (ISO 3104). Unless mentioned otherwise the viscosity is always measured at 50° C. throughout this text.

In a preferred embodiment the marine fuel is a very low sulfur fuel oil (VLSFO) with a sulfur content of not more than 0.5%.

The sulphur content of a marine fuel depends on the crude oil origin and the refining process. When a fuel burns, sulphur is converted into sulphur oxides. These oxides reach the lubricating oil via the blow-by gas and are corrosive to engine piston liners (see: Monique B. Vermeire, "Everything You Need to Know About Marine Fuels", published by Chevron Global Marine Products, June 2012)

For technical and ecological reasons low sulfur fuel are of increasing interest. Suitable low sulfur fuels may contain less than 1, 0.5, 0.2, or 0.1 wt % sulfur. An example is Shell@ ULSFO with less than 0.1 wt % sulfur.

Quaternary Ammonium Compounds

The at least one quaternary nitrogen component refer, in the context of the present invention, to nitrogen compounds quaternized in the presence of an acid or in an acid-free manner, preferably obtainable by addition of a compound comprising at least one oxygen- or nitrogen-containing group reactive with an anhydride and additionally at least one quaternizable amino group onto a polycarboxylic anhydride compound and subsequent quaternization.

In most cases the quaternary nitrogen component is an ammonium compound, however in the context of the present document morpholinium, piperidinium, piperazinium, pyrrolidinium, imidazolinium or pyridinium cations are also encompassed by the phrase "quaternary nitrogen component".

The quaternary ammonium compounds are preferably of the formula $$^{+}NR^1R^2R^3R^4A^-$$

in which $A^-$ stands for an anion, preferably a carboxylate $R^5COO^-$ or a carbonate $R^5O—COO^-$, and $R^1$, $R^2$, $R^3$, $R^4$, and $R^5$ independently of another are an organic residue with from 1 to 100 carbon atoms, substituted or unsubstituted, linear or branched alkyl, alkenyl or hydroxyalkyl residue with 1 to 100, more preferably 1 to 75, even more preferably 1 to 30, most preferably 1 to 25 and especially 1 to 20 carbon atoms, $R^5$ additionally may be substituted or unsubstituted cycloalkyl or aryl residues bearing 5 to 20, preferably 5 to 12 carbon atoms.

The organic residues $R^1$ to $R^5$ independently of another are preferably unsubstituted.

It is also possible that the anion may be multiply charged negatively, e.g. if anions of dibasic acids are used, in this case the stoichiometric ratio of the ammonium ions to the anions corresponds to the ratio of positive and negative charges.

The same is true for salts in which the cation bears more than one ammonium ion, e.g. of the substituents connect two or more ammonium ions.

In the organic residues the carbon atoms may be interrupted by one or more oxygen and/or sulphur atoms and/or one or more substituted or unsubstituted imino groups, and may be substituted by $C_6$-$C_{12}$-aryl, $C_5$-$C_{12}$-cycloalkyl or a five- or six-membered, oxygen-, nitrogen- and/or sulphur-containing heterocycle or two of them together form an unsaturated, saturated or aromatic ring which may be interrupted by one or more oxygen and/or sulphur atoms and/or one or more substituted or unsubstituted imino groups, where the radicals mentioned may each be substituted by functional groups, aryl, alkyl, aryloxy, alkyloxy, halogen, heteroatoms and/or heterocycles.

Two of the residues $R^1$ to $R^4$ may together form an unsaturated, saturated or aromatic ring, preferably a five-, six- or seven-membered ring (including the nitrogen atom of the ammonium ion).

In this case the ammonium cation may be a morpholinium, piperidinium, piperazinium, pyrrolidinium, imidazolinium or pyridinium cation.

In these Definitions $C_1$-$C_{20}$-alkyl which may be substituted by functional groups, aryl, alkyl, aryloxy, alkyloxy, halogen, heteroatoms and/or heterocycles is, for example, methyl, ethyl, propyl, isopropyl, n-butyl, sec-butyl, tert-butyl, pentyl, hexyl, heptyl, octyl, 2-ethylhexyl, 2,4,4-trimethylpentyl, decyl, dodecyl, tetradecyl, heptadecyl, octadecyl, eicosyl, 1,1-dimethylpropyl, 1,1-dimethylbutyl, 1,1,3,3-tetramethylbutyl, benzyl, 1-phenylethyl, 2-phenylethyl, α,α-dimethylbenzyl, benzhydryl, p-tolylmethyl, 1-(p-butylphenyl)ethyl, p-chlorobenzyl, 2,4-dichlorobenzyl, p-methoxybenzyl, methoxybenzyl, 2-cyanoethyl, 2-cyanopropyl, 2-methoxycarbonylethyl, 2-ethoxycarbonylethyl, 2-butoxycarbonylpropyl, 1,2-di-(methoxycarbonyl)ethyl, 2-methoxyethyl, 2-ethoxyethyl, 2-butoxyethyl, diethoxymethyl, diethoxyethyl, 1,3-dioxolan-2-yl, 1,3-dioxan-2-yl, 2-methyl-1,3-dioxolan-2-yl, 4-methyl-1,3-dioxolan-2-yl, 2-isopropoxyethyl, 2-butoxypropyl, 2-octyloxyethyl, chloromethyl, 2-chloroethyl, trichloromethyl, trifluoromethyl, 1,1-dimethyl-2-chloroethyl, 2-methoxyisopropyl, 2-ethoxyethyl, butylthiomethyl, 2-dodecylthioethyl, 2-phenylthioethyl, 2,2,2-trifluoroethyl, 2-hydroxyethyl, 2-hydroxypropyl, 3-hydroxypropyl, 4-hydroxybutyl, 6-hydroxyhexyl, 2-aminoethyl, 2-aminopropyl, 3-aminopropyl, 4-aminobutyl, 6-aminohexyl, 2-methylaminoethyl, 2-methylaminopropyl, 3-methylaminopropyl, 4-methylaminobutyl, 6-methylaminohexyl, 2-dimethylaminoethyl, 2-dimethylaminopropyl, 3-dimethylaminopropyl, 4-dimethylaminobutyl, 6-dimethylaminohexyl, 2-hydroxy-2,2-dimethylethyl, 2-phenoxyethyl, 2-phenoxypropyl, 3-phenoxypropyl, 4-phenoxybutyl, 6-phenoxyhexyl, 2-methoxyethyl, 2-methoxypropyl, 3-methoxypropyl, 4-methoxybutyl, 6-methoxyhexyl, 2-ethoxyethyl, 2-ethoxypropyl, 3-ethoxypropyl, 4-ethoxybutyl or 6-ethoxyhexyl, and $C_2$-$C_{20}$-alkyl interrupted by one or more oxygen and/or sulphur atoms and/or one or more substituted or unsubstituted imino groups is, for example, 5-hydroxy-3-oxa-pentyl, 8-hydroxy-3,6-dioxaoctyl, 11-hydroxy-3,6,9-trioxaundecyl, 7-hydroxy-4-oxaheptyl, 11-hydroxy-4,8-dioxaundecyl, 15-hydroxy-4,8,12-trioxapentadecyl, 9-hydroxy-5-oxanonyl, 14-hydroxy-5,10-oxatetradecyl, 5-methoxy-3-oxapentyl, 8-methoxy-3,6-dioxaoctyl, 11-methoxy-3,6,9-trioxaundecyl, 7-methoxy-4-oxaheptyl, 11-methoxy-4,8-dioxa-undecyl, 15-methoxy-4,8,12-trioxapentadecyl, 9-methoxy-5-oxanonyl, 14-methoxy-5,10-oxatetradecyl, 5-ethoxy-3-oxapentyl, 8-ethoxy-3,6-dioxaoctyl, 11-ethoxy-3,6,9-trioxaundecyl, 7-ethoxy-4-oxaheptyl, 11-ethoxy-4,8-dioxaundecyl, 15-ethoxy-4,8,12-trioxapentadecyl, 9-ethoxy-5-oxanonyl or 14-ethoxy-5,10-oxatetradecyl.

If two radicals form a ring, they can together be 1,3-propylene, 1,4-butylene, 1,5-pentylene, 2-oxa-1,3-propylene, 1-oxa-1,3-propylene, 2-oxa-1,3-propylene, 1-oxa-1,3-propenylene, 1-aza-1,3-propenylene, 1-$C_1$-$C_4$-alkyl-1-aza-1,3-propenylene, 1,4-buta-1,3-dienylene, 1-aza-1,4-buta-1,3-dienylene or 2-aza-1,4-buta-1,3-dienylene.

The number of oxygen and/or sulphur atoms and/or imino groups is not subject to any re-strictions. In general, there will be no more than 5 in the radical, preferably no more than 4 and very particularly preferably no more than 3.

Furthermore, there is generally at least one carbon atom, preferably at least two carbon atoms, between any two heteroatoms.

Substituted and unsubstituted imino groups can be, for example, imino, methylimino, isopropylimino, n-butylimino or tert-butylimino.

Furthermore, functional groups can be carboxy, carboxamide, hydroxy, di($C_1$-$C_4$-alkyl)amino, $C_1$-$C_4$-alkyloxycarbonyl, cyano or $C_1$-$C_4$-alkyloxy, $C_6$-$C_{12}$-aryl which may be substituted by functional groups, aryl, alkyl, aryloxy, alkyloxy, halogen, heteroatoms and/or heterocycles is, for example, phenyl, tolyl, xylyl, α-naphthyl, β-naphthyl, 4-diphenylyl, chlorophenyl, dichlorophenyl, trichlorophenyl, difluorophenyl, methylphenyl, dimethylphenyl, trimethylphenyl, ethylphenyl, diethylphenyl, isopropylphenyl, tert-butylphenyl, dodecylphenyl, methoxyphenyl, dimethoxyphenyl, ethoxyphenyl, hexyloxyphenyl, methylnaphthyl, isopropylnaphthyl, chloronaphthyl, ethoxynaphthyl, 2,6-dimethylphenyl, 2,4,6-trimethylphenyl, 2,6-dimethoxyphenyl, 2,6-dichlorophenyl, 4-bromophenyl, 2- or 4-nitrophenyl, 2,4- or 2,6-dinitrophenyl, 4-dimethylaminophenyl, 4-acetylphenyl, methoxyethylphenyl or ethoxymethylphenyl, $C_6$-$C_{12}$-cycloalkyl which may be substituted by functional groups, aryl, alkyl, aryloxy, alkyloxy, halogen, heteroatoms and/or heterocycles is, for example, cyclopentyl, cyclohexyl, cyclooctyl, cyclododecyl, methylcyclopentyl, dimethylcyclopentyl, methylcyclohexyl, dimethylcyclohexyl, diethylcyclohexyl, butylcyclohexyl, methoxycyclohexyl, dimethoxycyclohexyl, diethoxycyclohexyl, butylthiocyclohexyl, chlorocyclohexyl, dichlorocyclohexyl, dichlorocyclopentyl or a saturated or unsaturated bicyclic system such as norbornyl or norbornenyl, a five- or six-membered, oxygen-, nitrogen- and/or sulphur-containing heterocycle is, for example, furyl, thienyl, pyrryl, pyridyl, indolyl, benzoxazolyl, dioxolyl, dioxyl, benzimidazolyl, benzothiazolyl, dimethylpyridyl, methylquinolyl, dimethylpyrryl, methoxyfuryl, dimethoxypyridyl, difluoro-pyridyl, methylthienyl, isopropylthienyl or tert-butylthienyl and $C_1$ to $C_4$-alkyl is, for example, methyl, ethyl, propyl, isopropyl, n-butyl, sec-butyl or tert-butyl.

The residues $R^1$ to $R^5$ are preferably $C_2$-$C_{18}$-alkyl or $C_6$-$C_{12}$-aryl, more preferably $C_4$-$C_{16}$-alkyl or $C_6$-$C_{12}$-aryl, and even more preferably $C_4$-$C_{16}$-alkyl or $C_6$-aryl.

The residues $R^1$ to $R^5$ may be saturated or unsaturated, preferably saturated.

Preferred residues $R^1$ to $R^5$ do not bear any heteroatoms other than carbon or hydrogen.

Preferred examples of $R^1$ to $R^4$ are methyl, ethyl, propyl, isopropyl, n-butyl, sec-butyl, tert-butyl, pentyl, hexyl, heptyl, octyl, 2-ethylhexyl, 2,4,4-trimethylpentyl, 2-propylheptyl, decyl, dodecyl, tetradecyl, heptadecyl, octadecyl, eicosyl, 1,1-dimethylpropyl, 1,1-dimethylbutyl, 1,1,3,3-tetramethylbutyl, benzyl, 1-phenylethyl, 2-phenylethyl, α,α-dimethylbenzyl, benzhydryl, p-tolylmethyl or 1-(p-butylphenyl)ethyl.

In a preferred embodiment at least one of the residues $R^1$ to $R^4$ is selected from the group consisting of 2-hydroxyethyl, hydroxyprop-1-yl, hydroxyprop-2-yl, 2-hydroxybutyl or 2-hydroxy-2-phenylethyl.

In one embodiment $R^5$ is a polyolefin-homo- or copolymer, preferably a polypropylene, poly-butene or polyisobutene residue, with a number-average molecular weight ($M_n$) of 85 to 20000, for example 113 to 10000, or 200 to 10000 or 350 to 5000, for example 350 to 3000, 500 to 2500, 700 to 2500, or 800 to 1500. Preferred are polypropenyl, polybutenyl and polyisobutenyl radicals, for example with a number-average molecular weight $M_n$ of 3500 to 5000, 350 to 3000, 500 to 2500, 700 to 2500 and 800 to 1500 g/mol.

Preferred examples of anions $A^-$ are the anions of acetic acid, propionic acid, butyric acid, 2-ethylhexanoic acid, trimethylhexanoic acid, 2-propylheptanoic acid, isononanoic acid, versatic acids, decanoic acid, undecanoic acid, dodecanoic acid, saturated or unsaturated fatty acids with 12 to 24 carbon atoms, or mixtures thereof, salicylic acid, oxalic acid mono-$C_1$-$C_4$-alkyl ester, phthalic acid mono-$C_1$-$C_4$-alkyl ester, $C_{12}$-$C_{100}$-alkyl- and -alkenyl succinic acid, especially dodecenyl succinic acid, hexadecenyl succinic acid, eicosenyl succinic acid, and polyisobutenyl succinic acid. Further examples are methyl carbonate, ethyl carbonate, n-butyl carbonate, 2-hydroxyethyl carbonate, and 2-hydroxypropyl carbonate.

In one preferred embodiment the nitrogen compounds quaternized in the presence of an acid or in an acid-free manner are obtainable by addition of a compound which comprises at least one oxygen- or nitrogen-containing group reactive with an anhydride and additionally at least one quaternizable amino group onto a polycarboxylic anhydride compound and subsequent quaternization, especially with an epoxide, e.g. styrene or propylene oxide, in the absence of free acid, as described in WO 2012/004300, or with a carboxylic ester, e.g. dimethyl oxalate or methyl salicylate. Suitable compounds having at least one oxygen- or nitrogen-containing group reactive with anhydride and additionally at least one quaternizable amino group are especially polyamines having at least one primary or secondary amino group and at least one tertiary amino group, especially N,N-dimethyl-1,3-propane diamine, N,N-dimethyl-1,2-ethane diamine or N,N, N'-trimethyl-1,2-ethane diamine. Useful polycarboxylic anhydrides are especially dicarboxylic acids such as succinic acid, having a relatively long-chain hydrocarbyl substituent, preferably having a number-average molecular weight $M_n$ for the hydrocarbyl substituent of 200 to 10.000, in particular of 350 to 5000. Such a quaternized nitrogen compound is, for example, the reaction product, obtained at 40° C., of polyisobutenylsuccinic anhydride, in which the polyisobutenyl radical typically has an $M_n$ of 1000, with 3-(dimethylamino)propylamine, which constitutes a polyisobutenylsuccinic monoamide and which is subsequently quaternized with dimethyl oxalate or methyl salicylate or with styrene oxide or propylene oxide in the absence of free acid.

Further quaternized nitrogen compounds suitable as compounds are described in

WO 2006/135881 A1, page 5, line 13 to page 12, line 14;
WO 10/132259 A1, page 3, line 28 to page 10, line 25;
WO 2008/060888 A2, page 6, line 15 to page 14, line 29;
WO 2011/095819 A1, page 4, line 5 to page 9, line 29;
GB 2496514 A, paragraph [00012] to paragraph [00041];
WO 2013/117616 A1, page 3, line 34 to page 11, line 2;
WO 14/202425 A2, page 3, line 14 to page 5, line 9;
WO 14/195464 A1, page 15, line 31 to page 45, line 26 and page 75, lines 1 to 4;
WO 15/040147 A1, page 4, line 34 to page 5, line 18 and page 19, line 11 to page 50, line 10;
WO 14/064151 A1, page 5, line 14 to page 6, line 17 and page 16, line 10 to page 18, line 12;
WO 2013/064689 A1, page 18, line 16 to page 29, line 8; and
WO 2013/087701 A1, page 13, line 25 to page 19, line 30,
WO 13/000997 A1, page 17, line 4 to page 25, line 3,
WO 12/004300, page 5, lines 20 to 30, page 8, line 1 to page 10, line 10, and page 19, line 29 to page 28, line 3, each of which is incorporated herein by reference.

In one embodiment the quaternized ammonium compound is of formula

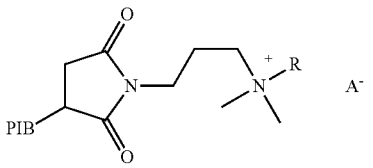

wherein in this formula

PIB stands for a polyisobutenyl residue having a number average molecular weight $M_n$ of from 550 to 2300, preferably from 650 to 1500 and more preferably from 750 to 1300 g/mol, R stands for an $C_1$- to $C_4$-alkyl or hydroxy-$C_1$- to $C_4$-alkyl, preferably methyl or 2-hydroxypropyl, and $A^-$ stands for an anion, preferably carboxylate $R^5COO^-$ or a carbonate $R^5O—COO^-$ as defined above, more preferably acetate, salicylate or methyloxalate.

In another preferred embodiment the quaternized ammonium compound is of formula

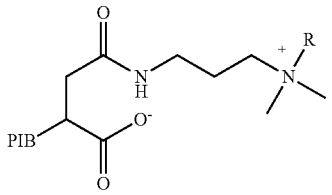

wherein in this formula

PIB stands for a polyisobutenyl residue having a number average molecular weight $M_n$ of from 550 to 2300, preferably from 650 to 1500 and more preferably from 750 to 1300 g/mol, R stands for a hydroxy-$C_1$- to $C_4$-alkyl, preferably 2-hydroxypropyl.

In another embodiment the quaternized compound is of formula

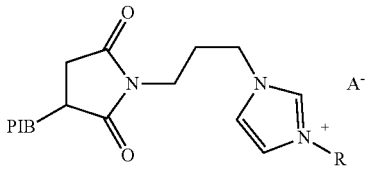

wherein in this formula

PIB stands for a polyisobutenyl residue having a number average molecular weight $M_n$ of from 550 to 2300, preferably from 650 to 1500 and more preferably from 750 to 1300 g/mol, R stands for an $C_1$- to $C_4$-alkyl or hydroxy-$C_1$- to $C_4$-alkyl, preferably methyl, and $A^-$ stands for an anion, preferably carboxylate $R^5COO^-$ or a carbonate $R^5O—COO^-$ as defined above, more preferably salicylate or methyloxalate.

In another embodiment the quaternized ammonium compound is of formula

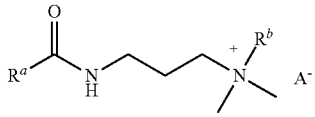

wherein in this formula $R^a$ stands for $C_1$-$C_{20}$-alkyl, preferably $C_9$- to $C_{17}$-alkyl, more preferably for undecyl, tridecyl, pentadecyl or heptadecyl, $R^b$ stands for a hydroxy-$C_1$- to $C_4$-alkyl, preferably 2-hydroxypropyl or 2-hydroxybutyl, and $A^-$ stands for an anion, preferably carboxylate $R^5COO^-$, as defined above, more preferably $R^5COO^-$ being a carboxylate of a fatty acid, especially $A^-$ being acetate, 2-ethylhexanoate, ole-ate, polyisobutenyl succinate or monoesters of polyisobutenyl succinate.

In one embodiment the quaternized ammonium compound is of formula

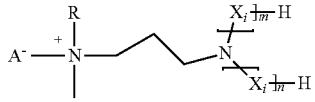

wherein in this formula $X_i$ for i=1 to n and 1 to m are independently of another selected from the group consisting of —$CH_2$—$CH_2$—O—, —$CH_2$—$CH(CH_3)$—O—, —$CH(CH_3)$—$CH_2$—O—, —$CH_2$—$C(CH_3)_2$—O—, —$C(CH_3)_2$—$CH_2$—O—, —$CH_2$—$CH(C_2H_5)$—O—, —$CH(C_2H_5)$—$CH_2$—O— and —$CH(CH_3)$—$CH(CH_3)$—O—, preferably selected from the group consisting of —$CH_2$—$CH(CH_3)$—O—, —$CH(CH_3)$—$CH_2$—O—, —$CH_2$—$C(CH_3)_2$—O—, —$C(CH_3)_2$—$CH_2$—O—, —$CH_2$—$CH(C_2H_5)$—O—, —$CH(C_2H_5)$—$CH_2$—O— and —$CH(CH_3)$—$CH(CH_3)$—O—, more preferably selected from the group consisting of —$CH_2$—$CH(CH_3)$—O—, —$CH(CH_3)$—$CH_2$—O—, —$CH_2$—$C(CH_3)_2$—O—, —$C(CH_3)_2$—$CH_2$—O—, —$CH_2$—$CH(C_2H_5)$—O— and —$CH(C_2H_5)$—$CH_2$—O—, most preferably selected from the group consisting of —$CH_2$—$CH(C_2H_5)$—O—, —$CH(C_2H_5)$—$CH_2$—O—, —$CH_2$—$CH(CH_3)$—O— and —$CH(CH_3)$—$CH_2$—O—, and especially selected from the group consisting of —$CH_2$—$CH(CH_3)$—O— and —$CH(CH_3)$—$CH_2$—O—, m and n independently of another are positive integers, with the proviso that the sum (m+n) is from 2 to 50, preferably from 5 to 40, more preferably from 10 to 30, and especially from 15 to 25, R stands for an $C_1$- to $C_4$-alkyl, preferably methyl, and $A^-$ stands for an anion, preferably carboxylate $R^5COO^-$ or a carbonate $R^5O$—$COO^-$ as defined above, more preferably salicylate or methyloxalate.

In another preferred embodiment the quaternized ammonium compound is of formula

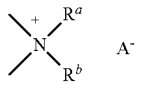

wherein in this formula $R^a$ and $R^b$ independently of another stand for $C_1$-$C_{20}$-alkyl or hydroxy-$C_1$- to $C_4$-alkyl, preferably $R^a$ stands for $C_1$-$C_{20}$-alkyl, preferably ethyl, n-butyl, n-octyl, n-dodecyl, tetradecyl or hexadecyl, and $R^b$ stands for hydroxy-$C_1$- to $C_4$-alkyl, preferably 2-hydroxypropyl, $A^-$ stands for an anion, preferably carboxylate $R^5COO^-$ or a carbonate $R^5O$—$COO^-$ as defined above, more preferably $C_{12}$-$C_{100}$-alkyl- and -alkenyl succinic acid, especially dodecenyl succinic acid, hexadecenyl succinic acid, eicosenyl succinic acid, and polyisobutenyl succinic acid.

Preferred quaternary ammonium compounds are selected from the group consisting of quaternized ammonium compounds of formula

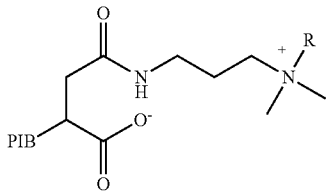

and quaternized ammonium compounds of formula

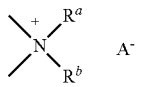

very preferred are quaternized ammonium compounds of formula

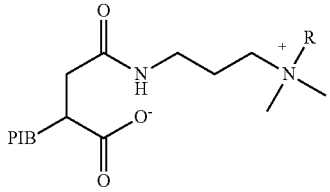

Usually at least one quaternary ammonium compound is used in the marine fuel, for example one to three, preferably one or two and especially one quaternary ammonium compound.

The at least one quaternary ammonium compound is used in the marine fuels in amounts of from 50 to 2000 ppm by weight, preferably 60 to 1500, and more preferably 70 to 1000 ppm by weight.

In exceptional cases, especially for testing purposes, the at least one quaternary ammonium compound is used in the marine fuels in amounts of from 20 to 5000 ppm by weight, preferably from 30 to 4000, and more preferably from 40 to 3000 ppm by weight.

In general the at least one quaternary ammonium compound is metered into the marine fuel as a solution in at least one solvent, for example, nonpolar organic solvents such as aromatic and aliphatic hydrocarbons, for example toluene, xylenes, white spirit and products sold under the trade names SHELLSOL (Royal Dutch/Shell Group) and EXXSOL (ExxonMobil), and also polar organic solvents, for example, alcohols such as 2-ethylhexanol, decanol and isotridecanol.

The mixing of the fuel and the at least one quaternary ammonium compound may be achieved by application of mechanical shear energy, e.g. in a stirred vessel or tank, shaking, rotor stator mixing, the turbulent flow through a pipe conveyed by pumps or by gravity, static mixers and counter current flow mixers. The mixing may also be achieved by a circulating the fuel through a loop, e.g. by pumping them from the bottom of a tank to the top of the tank, where they are dumped on the surface of the tank content. Prior to the circulating of the fuel and the water a pre-stirring is possible, but not required. In a preferred embodiment the at least one quaternary ammonium compound may be metered into the loop during circulation.

In another embodiment that at least one quaternary ammonium compound may be metered into the fuel pipe before the fuel is conveyed into the combustion chamber.

The quaternary ammonium compounds may be part of additive packages, which further to the quaternary ammonium compounds may comprise one or more selected from the group consisting of dehazers, antioxidants, metal deactivators, and solvents Dehazer Suitable dehazer are, for example, the alkali metal or alkaline earth metal salts of alkyl-substituted phenol- and naphthalenesulfonates and the alkali metal or alkaline earth metal salts of fatty acids, and also neutral compounds such as alcohol alkoxylates, e.g. alcohol ethoxylates, phenol alkoxylates, e.g. tert-butylphenol ethoxylate or tert-pentylphenol ethoxylate, fatty acids, alkylphenols, condensation products of ethylene oxide (EO) and propylene oxide (PO), for example including in the form of EO/PO block copolymers, polyethyleneimines or else polysiloxanes.

Further suitable dehazers are EO/PO-based alkoxylates of alkylphenol-formaldehyde condensates (Novolac, resol or calixarene type), EO/PO-based alkoxylates of diols (e.g. propandiol, ethylene glycole), triols (e.g. glycerol or trimethylolpropane), ethylene diamine, or polyethylene-imine. Further suitable dehazers are alkybenzene sulfonic acids, dialkylsulfosuccinates or alkali metal or ammonium salts thereof. Suitable dehazers are described in WO 96/22343. Further suitable dehazers based on diglycidyl ethers are described in U.S. Pat. Nos. 3,383,326 and 3,511,882.

Other suitable dehazers are, for example, alkoxylated phenol-formaldehyde condensates, for example the products available under the trade names NALCO 7D07 (Nalco) and TOLAD 2683 (Petrolite).

Antioxidants

Suitable antioxidants are, for example, substituted phenols, such as 2,6-di-tert-butylphenol, 2,6-di-tert-butyl-4-methyl phenol, 2,4-di-tert-butyl-6-methylphenol, preferably hindered phenols with an ester group bearing radical in para position, such as 3-[3,5-bis-(dimethylethyl)-4-hydroxy-phenyl] propanoic acid $C_6$- to $C_{20}$-alkyl esters, e.g. 2-ethylhexyl- or stearylester, and also phenylenediamines such as N,N'-di-sec-butyl-p-phenylenediamine.

Metal Deactivators

Suitable metal deactivators are, for example, salicylic acid derivatives such as N,N'-disalicylidene-1,2-propanediamine.

Solvents

Suitable solvents are, for example, nonpolar organic solvents such as aromatic and aliphatic hydrocarbons, for example toluene, xylenes, white spirit and products sold under the trade names SHELLSOL (Royal Dutch/Shell Group) and EXXSOL (ExxonMobil), and also polar organic solvents, for example, alcohols such as 2-ethylhexanol, 2-propylheptanol, decanol, isotridecanol and isoheptadecanol. Such solvents are usually added to the fuel together with the aforementioned additives and coadditives, which they are intended to dissolve or dilute for bet-ter handling.

The above-mentioned quaternary ammonium compounds dissolve or disperse asphaltenes in marine fuels and are especially effective in marine fuels with a low weight ratio of aromatics to asphaltenes. Thus, the quaternary ammonium compounds are especially effective against fouling of asphaltenes precipitating from marine fuels.

They are especially useful for removing and/or preventing precipitates from the marine-fuels in tanks, nozzles, flanges, pumps, fuel pipelines, fuel filters and/or separators.

The amounts given throughout the text refer to the pure components excluding e.g. solvent, unless stated otherwise.

EXAMPLES

Analytical Methods

SARA analyses were performed on the components according to IP 469 via TLC-FID using a Latroscan® MK 6 from company NTS America, Inc.

In addition, sulfur contents via EN ISO 8754:2003-12 were determined. Values are given in weight %, unless stated otherwise.

Total sediment (TSE) was determined according to ISO 10307-1:2009(E).

Potential total sediment (TSP) was determined according to ISO 10307-2:2009(E), procedure A. Accelerated total sediment (TSA) was determined according to ISO 10307-2:2009(E), procedure B.

Materials

4-Dodecylbenzenesulfonic acid (DBSA, CAS 121-65-3) was obtained from Aldrich.

N-Vinylpyrrolidone-Hexadecen-Copolymer Ganex™ V-216 (see WO 2012/039900) was obtained from company Ashland.

The inventive quaternary ammonium compound Quat1 was prepared from polyisobutene-substituted succinic anhydride (from polyisobutene with a molecular weight of 1000), 3-dimethylamino-propane-1-amine and propylene oxide (PO) in analogy to Herstellungsbeispiel 1 from WO 2012/004300 by replacing styrene oxide by PO.

Fuel components 1 to 4 were used for blending of Marine fuels:

| | Component 1 | Component 2 | Component 3 | Component 4 |
|---|---|---|---|---|
| Saturates(1) [%] | 6.38 | 6.45 | 42.67 | 11.14 |
| Aromatics and Polyaromatics(1) [%] | 34.23 | 82.78 | 17.87 | 85.24 |
| Resins(1) [%] | 47.6 | 9.94 | 18.84 | 3.07 |
| Asphaltenes(1) [%] | 11.79 | 0.82 | 20.62 | 0.56 |
| Sulfur content [%] | 0.77 | 0.94 | 0.03 | 0.066 |
| TSE [%] | 0.06 | 0.04 | 0.01 | 0.01 |
| TSP [%] | 0.06 | 0.04 | 0.01 | 0.01 |
| TSA [%] | 0.06 | 0.04 | 0.01 | 0.01 |

(1)Measured according to IP 469

Marine fuels 1-3 were blended according to the following table (wt %):

| | Component 1 | Component 2 | Component 3 | Component 4 |
|---|---|---|---|---|
| Marine fuel 1 | 45% | 10% | 35% | 10% |
| Marine fuel 2 | 32% | 20% | 38% | 10% |
| Marine fuel 3 | 35% | 20% | 18% | 27% |

For Marine fuels 1-3 the following properties were calculated from their compositions:

| | Marine fuel 1 | Marine fuel 2 | Marine fuel 3 |
|---|---|---|---|
| Saturates(1) [%] | 19.56 | 20.66 | 14.21 |
| Aromatics and Polyaromatics(1) [%] | 38.46 | 42.83 | 54.77 |
| Resins(1) [%] | 29.32 | 24.69 | 22.87 |
| Asphaltenes(1) [%] | 12.66 | 11.83 | 8.15 |
| Sulfur content [%] | 0.46 | 0.45 | 0.48 |
| Wt Ratio Aromatics:Asphaltenes | 3.0 | 3.6 | 6.7 |

(1)Measured according to IP 469

The components were blended in the order 2, 4, 1, 3. In the case of dispersant additization, the respective additive was dissolved in component 2 and then blended in the other components were added in the order 4, 1, 3.

| Type | Marine fuel | Additive | Additive dosage active compound [ppm] | TSP [%] | TSP improvement over reference |
|---|---|---|---|---|---|
| Reference | 1 | None | | 0.16 | |
| Inventive Example 1 | 1 | Quat1 | 250 | 0.11 | −34% |
| Comparative Example 1 | 1 | DBSA | 562 | 0.17 | +5% |
| Comparative Example 2 | 1 | Ganex ™ V-216 | 511 | 0.12 | −25% |
| Reference | 2 | None | | 0.10 | |
| Inventive Example 2 | 2 | Quat1 | 250 | 0.06 | −40% |

-continued

| Type | Marine fuel | Additive | Additive dosage active compound [ppm] | TSP [%] | TSP improvement over reference |
|---|---|---|---|---|---|
| Reference | 3 | None | | 0.03 | |
| Inventive Example 3 | 3 | Quat1 | 250 | 0.02 | −26% |

The potential total sediment (TSP value, total sediment aged) is the total amount of sediment that can be formed under normal storage conditions, excluding external influences. If the potential total sediment aged of the heavy fuel oil markedly exceeds the specification value (0.10% in/in maximum) for all grades of intermediate (IFOs) and heavy fuel oils (HFOs)), problems with the fuel cleaning system can occur, fuel filters can get plugged and combustion can become erratic.

| | Marine fuel 1 | Marine fuel 2 | Marine fuel 3 |
|---|---|---|---|
| Saturates(1) [%] | 19.56 | 20.66 | 14.21 |
| Aromatics and Polyaromatics(1) [%] | 38.46 | 42.83 | 54.77 |
| Resins(1) [%] | 29.32 | 24.69 | 22.87 |
| Asphaltenes(1) [%] | 12.66 | 11.83 | 8.15 |
| Wt Ratio Aromatics:Asphaltenes | 3.0 | 3.6 | 6.7 |
| TSP Improvement | −34% | −40% | −26% |

(1)Measured according to IP 469

It can easily be seen that the quaternary compound according to the invention reduces the potential total sediment more than compounds known from the prior art. This effect is more pronounced the lower the content of aromatics and polyaromatics in the marine fuel respectively the weight ratio of aromatics to asphaltenes is.

Marine fuels 4 and 5 were commercially available with compositions as follows:

| | Marine fuel 4 | Marine fuel 5 |
|---|---|---|
| Saturates(1) [%] | 67.85 | 63.90 |
| Aromatics and Polyaromatics(1) [%] | 14.38 | 12.73 |
| Resins(1) [%] | 11.20 | 17.03 |
| Asphaltenes(1) [%] IP 469) | 6.57 | 6.33 |
| Sulfur content [%] | 0.47 | 0.47 |
| Wt Ratio Aromatics (1):Asphaltenes (1) | 2.19 | 2.01 |

(1)Measured according to IP 469

| Type | Marine fuel | Additive | Additive dosage active compound [ppm] | TSP [%] | TSP improvement over reference |
|---|---|---|---|---|---|
| Reference | 4 | None | | 0.22 | |
| Inventive Example 4 | 4 | Quat1 | 250 | 0.09 | −55% |
| Reference | 5 | None | | 0.10 | |
| Inventive Example 5 | 5 | Quat1 | 250 | 0.07 | −30% |

The invention claimed is:

1. A process, comprising:

dissolving or dispersing asphaltenes in a marine fuel by adding at least one quaternary ammonium compound, the marine fuel comprising 5 to 70 wt % saturates (determined according to SARA analysis using TLC-FID, IP 469), 10 to 85 wt % aromatics (determined according to SARA analysis using TLC-FID, IP 469), and 1 to 30 wt % asphaltenes (determined according to SARA analysis using TLC-FID, IP 469), with the proviso that a sum of the saturates, the aromatics, and the asphaltenes is less than 100 wt %, wherein a weight ratio of the aromatics to the asphaltenes is not more than 7.0.

2. A marine fuel composition, comprising:

5 to 70 wt % saturates (determined according to SARA analysis using TLC-FID, IP 469), 10 to 85 wt % aromatics (determined according to SARA analysis using TLC-FID, IP 469), 1 to 30 wt % asphaltenes (determined according to SARA analysis using TLC-FID, IP 469), and 50 to 2000 ppm by weight of at least one quaternary ammonium compound, wherein a weight ratio of the aromatics to the asphaltenes is not more than 7.0.

3. A process for reducing or preventing fouling caused by asphaltenes in a marine fuel, the marine fuel comprising:

5 to 70 wt % saturates (determined according to SARA analysis using TLC-FID, IP 469), 10 to 85 wt % aromatics (determined according to SARA analysis using TLC-FID, IP 469), 1 to 30 wt % asphaltenes (determined according to SARA analysis using TLC-FID, IP 469), and wherein a weight ratio of the aromatics to the asphaltenes is not more than 7.0, wherein the process comprises adding 50 to 2000 ppm by weight of at least one quaternary ammonium compound to the said marine fuel.

4. The process according to claim 3, wherein a potential total sediment (TSP) value, determined according to ISO 10307-2:2009 (E), procedure A, of an unadditised marine fuel is reduced by at least 25% by adding the indicated amounts of the at least one quaternary ammonium compound to the said marine fuel.

5. The process according to claim 1, wherein the marine fuel is selected from the group consisting of ISO-F-DMX, DMA, DFA, DMZ, DFZ, and DFB, and ISO-F RMA, RMB, RMD, RME, RMG, and RMK according to DIN ISO 8217.

6. The process according to claim 1, wherein the marine fuel is selected from the group consisting of MGO (Marine gas oil), MDO (Marine diesel oil), IFO (Intermediate fuel oil), MFO (Marine fuel oil), HFO (Heavy fuel oil), IFO 380 (<3.5% sulphur), IFO 180 (<3.5% sulphur), LS 380 (<1.0% sulphur), LS 180 (<1.0% sulphur), LSMGO (<0.1% sulphur), and ULSMGO (sulphur 0.0015% max).

7. The process according to claim 1, wherein the at least one quaternary ammonium compound is of a formula $$^{+}NR^{1}R^{2}R^{3}R^{4}A^{-}$$

in which $A^{-}$ stands for an anion, and $R^{1}$, $R^{2}$, $R^{3}$, $R^{4}$, and $R^{5}$ independently of another are an organic residue with from 1 to 100 carbon atoms, substituted or unsubstituted, linear or branched alkyl, alkenyl or hydroxyalkyl residue with 1 to 100 carbon atoms, $R^5$ additionally may be substituted or unsubstituted cycloalkyl or aryl residues bearing 5 to 20 carbon atoms.

8. The process according to claim 1, wherein the at least one quaternary ammonium compound is of formula

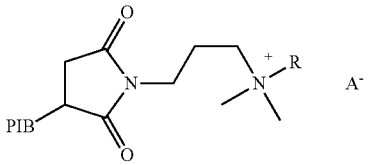

wherein in this formula

PIB stands for a polyisobutenyl residue having a number average molecular weight $M_n$ of from 550 to 2300 g/mol, R stands for a $C_1$- to $C_4$-alkyl or hydroxy-$C_1$- to $C_4$-alkyl, and $A^-$ stands for an anion.

9. The process according to claim 1, wherein the at least one quaternary ammonium compound is of formula

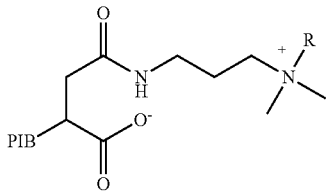

wherein in this formula

PIB stands for a polyisobutenyl residue having a number average molecular weight $M_n$ of from 550 to 2300 g/mol, and R stands for a hydroxy-$C_1$- to $C_4$-alkyl.

10. The process according to claim 1, wherein the at least one quaternary ammonium compound is of formula

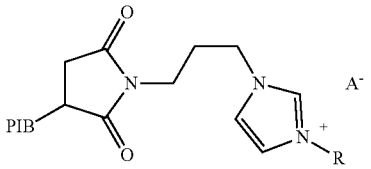

wherein in this formula

PIB stands for a polyisobutenyl residue having a number average molecular weight $M_n$ of from 550 to 2300 g/mol, R stands for an $C_1$- to $C_4$-alkyl or hydroxy-$C_1$- to $C_4$-alkyl, and $A^-$ stands for an anion.

11. The process according to claim 1, wherein the at least one quaternary ammonium compound is of formula

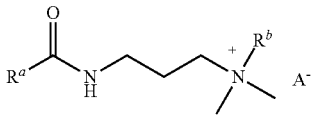

wherein in this formula $R^a$ stands for $C_1$-$C_{20}$-alkyl, $R^b$ stands for a hydroxy-$C_1$- to $C_4$-alkyl, and $A^-$ stands for an anion.

12. The process according to claim 1, wherein the at least one quaternary ammonium compound is of formula

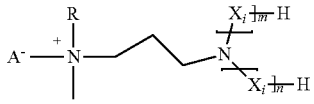

wherein in this formula $X_i$ for i=1 to n and 1 to m are independently of another selected from the group consisting of —$CH_2$—$CH_2$—O—, —$CH_2$—$CH(CH_3)$—O—, —$CH(CH_3)$—$CH_2$—O—, —$CH_2$—$C(CH_3)_2$—O—, —$C(CH_3)_2$—$CH_2$—O—, —$CH_2$—$CH(C_2H_5)$—O—, —$CH(C_2H_5)$—$CH_2$—O— and —$CH(CH_3)$—$CH(CH_3)$—O—, m and n independently of another are positive integers, with the proviso that a sum (m+n) is from 2 to 50, R stands for an $C_1$- to $C_4$-alkyl, and $A^-$ stands for an anion.

13. The process according to claim 1, wherein the at least one quaternary ammonium compound is of formula

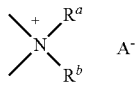

wherein in this formula $R^a$ and $R^b$ independently of another stand for $C_1$-$C_{20}$-alkyl or hydroxy-$C_1$- to $C_4$-alkyl, and $A^-$ stands for an anion.

14. The process according to claim 7, wherein the marine fuel has a content of aromatics and polyaromatics according to IP 469 of not more than 50 wt %.

15. The process according to claim 1, wherein the at least one quaternary ammonium compound is used in the marine fuel in amounts of from 20 to 5000 ppm by weight.

16. The process according to claim 1, wherein the marine fuel comprises:

10 to 50 wt % saturates, 30 to 70 wt % aromatics, and 5 to 20 wt % asphaltenes, and wherein the weight ratio of the aromatics to the asphaltenes is not more than 4.0.

17. The marine fuel composition according to claim 2, comprising:

10 to 50 wt % saturates, 30 to 70 wt % aromatics, 5 to 20 wt % asphaltenes, and 70 to 1000 ppm by weight of at least one quaternary ammonium compound, and wherein the weight ratio of the aromatics to the asphaltenes is not more than 4.0.

18. The process according to claim 3, wherein the marine fuel comprises:

10 to 50 wt % saturates, 30 to 70 wt % aromatics, and 5 to 20 wt % asphaltenes, and wherein the weight ratio of the aromatics to the asphaltenes is not more than 4.0, and wherein the process further comprises adding 70 to 1000 ppm by weight of at least one quaternary ammonium compound to the said marine fuel.

19. The process according to claim 4, wherein the TSP value, determined according to ISO 10307-2:2009 (E), procedure A, of the unadditised marine fuel is reduced by at least 40% by adding the indicated amounts of at least one quaternary ammonium compound to the said marine fuel.

20. The process according to claim 1, wherein non-ionic alkoxylate surfactants are not employed.

* * * * *